United States Patent [19]

Beitecke et al.

[11] 4,338,801

[45] Jul. 13, 1982

[54] AUTOMATIC TOWEL DISPENSER

[75] Inventors: Bernd Beitecke, Dortmund; Reinhold Schmidt, Bochum, both of Fed. Rep. of Germany

[73] Assignee: LUK Lamellen und Kupplungsbau GmbH, Bühl, Fed. Rep. of Germany

[21] Appl. No.: 244,901

[22] Filed: Mar. 18, 1981

Related U.S. Application Data

[63] Continuation of Ser. No. 50,640, Jun. 21, 1979, abandoned.

[30] Foreign Application Priority Data

Jun. 21, 1978 [DE] Fed. Rep. of Germany ..... 2827218

[51] Int. Cl.[3] ..... A47K 10/30

[52] U.S. Cl. ..... 68/13 R; 226/118

[58] Field of Search ..... 68/9, 13 R; 312/38; 38/2; 221/27-29; 226/115, 118, 127, 133; 15/40

[56] References Cited

U.S. PATENT DOCUMENTS

| | | | |
|---|---|---|---|
| 1,883,987 | 10/1932 | Lasowsky | 226/118 X |
| 2,295,955 | 9/1942 | LaPage | 68/13 R X |
| 3,072,311 | 1/1963 | Cohen | 226/118 X |
| 4,022,368 | 5/1977 | Ando et al. | 226/118 |

FOREIGN PATENT DOCUMENTS 2602278 7/1977 Fed. Rep. of Germany ..... 68/13 R

*Primary Examiner*—Philip R. Coe

*Attorney, Agent, or Firm*—Kontler, Grimes & Battersby

[57] ABSTRACT

An automatic towel dispenser has a housing containing a washing and a drying chamber for an endless towel passable therethrough and has a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein and a second supply chamber for variably stacking a plurality of cleaned towel sections of the endless towel therein, the sections of the towel being depositable from above into the respective supply chamber therefor and being withdrawable from below an overlying loop thereof. The dispenser is improved with a shaft separated from the respective supply chamber and traversible by the towel sections withdrawable from the respective supply chamber.

4 Claims, 1 Drawing Figure

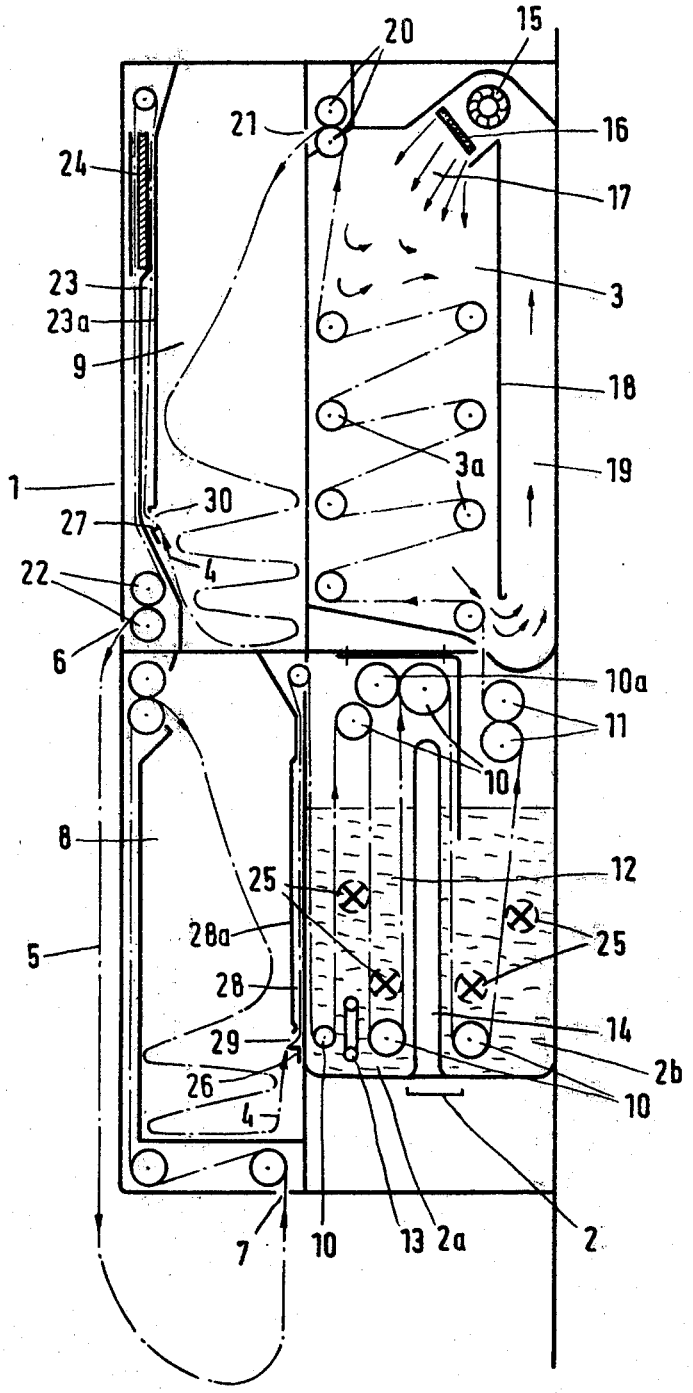
I

AUTOMATIC TOWEL DISPENSER

This is a continuation, division of application Ser. No. 050,640, filed June 21, 1979, and now abandoned.

The invention relates to an automatic towel dispenser having a housing containing a washing and a drying chamber for an endless towel passable therethrough and having a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the soiled towel sections, after emptying of a given quantity of the cleaned towel sections, being passable through the washing and drying chambers, while washing and drying processes are set into operation, and being depositable in the second supply chamber for cleaned towel sections.

Such towel dispensers have become known heretofore from German Published Non-prosecuted Application DE-OS No. 26 02 278.

It is an object of the invention of the instant application to provide an automatic towel dispenser wherein guidance or travel of the towel from the supply chambers into the wash tank and out of the delivery slot, respectively, is improved while ensuring that towel folds or loops are not carried along in the process.

With the foregoing and other objects in view, there is provided, in accordance with the invention, in an automatic towel dispenser having a housing containing a washing and a drying chamber for an endless towel passable therethrough and having a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the soiled towel sections, after emptying of a given quantity of the cleaned towel sections, being passable through the washing and drying chambers, while washing and drying processes are set into operation, and being depositable in the second supply chamber for cleaned towel sections, the sections of the towel being depositable from above into the respective supply chamber therefor and being withdrawable from below an overlying loop thereof, an improvement therein which comprises a shaft separated from the respective supply chamber and traversible by the towel sections withdrawable from the respective supply chamber. The shaft through which the towel sections pass permit any towel folds or loops that may have been drawn into the shaft to unfold or straighten out therein and, furthermore, such folds or loops have no adverse effect upon the position of the layers of toweling contained in the supply chamber.

In accordance with another feature of the invention, the shaft has an inlet thereto from the respective supply chamber, the towel being drawable along a travel path from the supply chamber to the inlet, and the dispenser includes means defining a deflection contour located in front of the inlet and projecting into the travel path of the towel from the respective supply chamber to the inlet. Through this deflection contour, by which the towel is pushed out of the path of travel thereof, the folds are broken up or unfolded before they even enter the shaft through which the towel passes.

In accordance with a further feature of the invention, the inlet to the shaft is offset with respect to the means defining the deflection contour because, then, a forced, loop-like or looping guidance of the towel is effected which counteracts the entry of folds into the shaft.

In accordance with an added feature of the invention, the passageway or unfolding shaft is at least approximately vertical i.e. is at least approximately parallel to the respective supply chamber, into which the towel is deposited from above.

In accordance with a concomitant feature of the invention, the inlet to the passage shaft is at a location which is at most at one-half the height of the respective supply chamber.

Other features which are considered as characteristic for the invention are set forth in the appended claims.

Although the invention is illustrated and described herein as embodied in an automatic towel dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE of the drawing which is a diagrammatic view of the automatic towel dispenser according to the invention:

Referring now to the FIGURE of the drawing, there is shown therein the automatic towel dispenser I according to the invention having a housing 1 with a washing chamber 2 and a drying chamber 3 provided therein. An endless towel 4, that is to be passed through the chambers 2 and 3, has cleaned towel sections 5 thereof, which are either ready or to be made ready for use, that extend between a delivery slot 6 and an inlet slot 7 on the outside of the housing 1. Between the inlet slot 7 and the washing chamber 2, as viewed in the direction of travel of the towel 4 represented by the various arrow heads shown thereon, a supply chamber 8 for the variable or alternating stacking of several used towel sections is provided. Between the drying chamber 3 and the delivery slot 6, a supply chamber 9 for the variable or alternating stacking of several clean towel sections is also provided. After the supply chamber 9 is sufficiently empty or the supply chamber 8 is sufficiently full, the towel dispenser is set into operation and a suitable number of soiled towel sections from the supply chamber 8 is initially passed through the washing and drying chambers 2 and 3 and then deposited in the supply chamber 9 for clean toweling.

The washing chamber 2 consists of a wash tub 2*a* and a rinsing tub 2*b*, through which the towel is conducted in the form of at least approximately vertical loops and over deflection rolles 10, past stirring or vane cylinders 25. At the outlet from the wash tub 2*a*, squeezing rollers or cylinders 10*a* are provided and at the outlet of the rinsing tube 2*b*, squeezing cylinders 11. Heating rods 13 or the like are provided for heating the washing solution 12 in the wash tub 2*a*. A partition 14 is disposed between the wash and the rinsing tubs 2*a* and 2*b*, respectively.

After passing the squeezing cylinders 11, the towel 4 arrives in the drying chamber 3, wherein it is guided in looping from over deflection or reversing rollers 3*a*. A blower 15 with a heater 16 is provided in an upper region of the drying chamber 3, and blows drying air in the direction of the arrows 17 onto the towel 4. Through an intake or induction shaft 19 separated by a partition 18 from the drying chamber 3, the drying air is sucked upwardly from below to the blower 15 and is there blown out again into the drying chamber 3. The drying air is thus displaced in a counterflow manner with respect to the travel of the towel 4. A pair of transport rollers 20 advances the dried towel 4 through an inlet slot 21 into the supply chamber 9, depositing the towel 4 therein in loop form. If fresh towling is required, either, by pressing a suitable actuation switch, a pair of rollers 22 is set in motion for a given amount of rotation or by manually pulling down the towel section 5, fresh toweling is drawn out through the slot 6, whereby the fresh toweling located in the supply chamber 9 is drawn upwardly from the lower layers thereof through the unfolding shaft 23 and past a flattening or ironing device 24, onward to the rollers or cylinders 22 and out through the slot 6.

The sections 4 of the towel drawn out from under the overlying towel loops in the supply chambers 8 and 9 are guided initially upwardly and past members formed with deflection contours 26 and 27 which project into the path of travel of these towel sections that are being drawn away, and thus cause a deflection in the path of travel of the towel, whereby the passage of folds in the towel is withheld. Subsequently, the towel sections pass through respective inlet openings 29, 30 into the respective shafts 28 and 23, which are separated from the respective supply chambers 8 and 9 by a baffle plate or sheet 28*a* and 23*a*, respectively, and afford an opportunity to any folds that may have been drawn into the shaft 23, 28, to unfold. It can readily be seen from the FIGURE of the drawing that the unfolding shafts 28, 23 have a length which is greater than onehalf the length of the respective supply chambers 8 and 9.

There are claimed:

1. An automatic dispenser for an endless towel, comprising a housing having a delivery slot and an inlet slot; a washing and a drying chamber provided in said housing and defining first and second portions of an elongated path for the endless towel a cleaned section of which is available for use externally of said housing between said slots and which is movable along said path in a direction from said inlet slot, through said washing chamber, through said drying chamber and to said delivery slot; and means provided in said housing and defining additional portions of said path, including a first supply chamber for variably stacking and looping a plurality of superimposed soiled towel sections between said inlet slot and said washing chamber, a second supply chamber for variably stacking and looping a plurality of superimposed cleaned towel sections between said drying chamber and said delivery slot, said supply chambers having upper portions provided with inlets for admission of the towel sections into their interior from above and lower portions wherein the loops of towel sections begin to form and pile up on top of each other, and first and second unfolding shafts having entry slots respectively communicating with said first and second supply chambers at levels above the respective lower portions and at most halfway between the upper and lower portions of the respective supply chambers, said first shaft being disposed between said first supply chamber and said washing chamber and said second shaft being disposed between said second supply chamber and said delivery slot.

2. The dispenser of claim 1, wherein said housing further comprises towel deflecting means provided in the regions of entry slots of said shafts and extending into the respective portions of said path.

3. The dispenser of claim 2, wherein said entry slots are offset relative to the respective deflecting means.

4. The dispenser of claim 1, wherein said shafts are at least substantially vertical.

* * * * *